US007516568B2

(12) United States Patent
Wightman

(10) Patent No.: US 7,516,568 B2
(45) Date of Patent: Apr. 14, 2009

(54) CALENDAR

(76) Inventor: Paul Wightman, 5028 N. 2300 West, Cedar City, UT (US) 84720

( * ) Notice: Subject to any disclaimer, the term of this patent is extended or adjusted under 35 U.S.C. 154(b) by 59 days.

(21) Appl. No.: 11/890,917

(22) Filed: Aug. 7, 2007

(65) Prior Publication Data

US 2008/0028645 A1 Feb. 7, 2008

Related U.S. Application Data

(60) Provisional application No. 60/835,949, filed on Aug. 7, 2006.

(51) Int. Cl.
*G09D 3/00* (2006.01)

(52) U.S. Cl. ..... 40/107; 206/531; 273/139

(58) Field of Classification Search ..... 40/107; 283/2–4; 206/531, 532, 534
See application file for complete search history.

(56) References Cited

U.S. PATENT DOCUMENTS 780,086 A * 1/1905 Brewer ..... 273/139
1,520,648 A * 12/1924 Holt ..... 40/107
2,301,970 A * 11/1942 Rau ..... 273/139
2,310,574 A * 2/1943 Cartwright ..... 273/139
2,831,278 A * 4/1958 Myers ..... 40/107
2,914,871 A * 12/1959 Smith et al. ..... 40/107
3,290,812 A * 12/1966 Hunkins ..... 40/107
4,472,894 A * 9/1984 Wightman ..... 40/107
5,974,032 A * 10/1999 Snowden et al. ..... 370/316
7,401,702 B2 * 7/2008 Hession ..... 206/531

* cited by examiner

*Primary Examiner*—Paul N Dickson
*Assistant Examiner*—Shin Kim
(74) *Attorney, Agent, or Firm*—TraskBritt, PC

(57) ABSTRACT

A calendar is formed of a plurality of substrates. A first substrate carries indicia thereon which identifies selected time periods, such as days or months of the year. A second substrate is positioned adjacent to the first substrate. The second substrate defines a plurality of cavities dimensioned to individually retain a respective information carrying article, such as a web. Each of the cavities is corresponding supplied with a respective information carrying article. Each indicia on the first substrate is positionally associated with a respective cavity in the second substrate. A third substrate, positioned adjacent to the second substrate, is positioned to retain the information carrying articles releasably within the second substrate. The third substrate provides a rupturable cover over each of the cavities of the second substrate whereby upon the application of a sufficient lateral force on the information carrying article within a selected cavity, the article passes through the cover to a location wherein the article may be retrieved by the user. The lateral force may be applied by the user's finger or alternatively a tool or other object adapted for the application of such force.

17 Claims, 18 Drawing Sheets

CALENDAR

CROSS-REFERENCE TO RELATED APPLICATION

This application claims the benefit under 35 U.S.C. §119 (e) of U.S. Provisional Application No. 60/835,949 filed 7 Aug. 2006.

FIELD OF INVENTION

This invention relates to structures for identifying the various days of the year, e.g., calendars. More particularly, the invention is directed to a calendar that not only provides an identification of the various days of the year, but furthermore, may be used to provide information, entertainment, education or other benefits, especially on a daily basis.

BACKGROUND

Calendars, as a traditional method of identifying the arrangement of days and months of a year, are well known. Such calendars have heretofore been configured in various forms and constructions. In the most conventional presentation, a calendar includes a planar substrate having an indication thereon of the twelve months, which together constitute the traditional year. A grouping of the various days, which together constitute an individual month, may also be indicated. Oftentimes, calendars adopt a configuration whereby each day is associated with a respective day of the week, e.g., a Wednesday.

Calendars provide the user with a means of readily identifying a specific day as well as the day of the week, month and or year associated with that day. While the information previously provided by traditional calendars is very helpful to the user, it has been previously recognized that calendars may be utilized to provide a user with other utility beyond that historically associated with traditional calendars. Representative efforts in this regard are disclosed in U.S. Pat. No. 780,086 (Brewer et al.); U.S. Pat. No. 1,520,648 (Holt); U.S. Pat. No. 2,301,970 (Rau); U.S. Pat. No. 2,831,278 (Myers); U.S. Pat. No. 2,914,871 (Smith et al.); and U.S. Pat. No. 3,290,812 (Hunkins).

An interesting development in the calendar art was the calendar construction disclosed in U.S. Pat. No. 4,472,894 (Wightman). This particular calendar construction provided a traditional first substrate having the conventional calendar indicia disposed on an outer surface thereof. The outer substrate was associated with a secondary substrate having a plurality of elongate channels formed therein. The longitudinal axis of each of these channels was oriented perpendicular to the surface of the outer substrate. A third substrate, formed by a thin sheet of paper, was positioned adjacent to the second substrate whereby the elongate channel was sealed on each of its opposing ends, i.e., the first end of the channel being sealed by the outer substrate while the second opposing end was sealed by the third substrate. Positioned within each of these elongate channels is a respective paper roll having a message printed thereon such as a horoscope, quotation, riddle or other information. Each of the elongate channels was associated with a respective day of the calendar whereby the user could punch through the outer substrate and thereafter displace the paper roll through the third substrate and thereby cause the paper roll to be displaced outwardly from the third substrate. A channeling structure was positioned proximate the back surface of the third substrate for directing the dislodged paper roll to a collection tray positioned below the assembly of the three substrates.

While the '894 calendar structure provides a number of interesting benefits, it is also limited in its usefulness due to the nature of its construction, For example, the orientation of the elongate channels, perpendicular to the planar surface of the first substrate, requires the calendar to have a considerable thickness. This thickness requirement severely limits the environments wherein this particular type of calendar can be employed. For example, this thickness requirement may limit the manufacture of smaller versions of the calendar, e.g., a desk top version. Furthermore, the '894 calendar requires the user to utilize a tool in order to operate the calendar. This tool is easily misplaced thereby rendering the calendar inoperative.

There continues to exist a need for a calendar construction that at once provides the user with the information conveyed by a conventional calendar while also permitting the user to be supplied with a daily informational or entertainment article that may be used in environments that are spatially constrained.

SUMMARY OF THE INVENTION

A calendar of the invention is formed of a plurality of substrates that are associated one with another to form an assembly that defines a series of indicia identifying the various days of a time period, e.g., calendar month. The substrates form a structure for retaining a plurality of articles to be dispensed from the calendar and a further structure that facilitates the orderly dispensing of those articles. The dispensing of the articles is typically associated with individual days of the calendar. In one embodiment, a series of voids or retaining channels are defined within one or more of the substrates. These voids may be positioned behind the indicia. Applying a force to the indicia or in the vicinity of the indicia results in the article, positioned behind the indicia, being discharged. A passageway is defined within the assembly that leads from the voids to a centralized collection location. The indicia may be disposed on a flexible sheet of material that is displaceable by the user whereby upon the application of a sufficient force on the indicia, the flexible sheet is displaced against an article retained within a respective void positioned behind the flexible sheet thereby causing the article to be dislodged from the void into the passageway and thereafter to the collection location. One or more of the voids or retaining channels is elongate in configuration and defines a longitudinal axis that is oriented parallel with the plane of the front surface of the calendar or alternatively with the substrate that defines the void. This orientation of the longitudinal axis facilitates the retention of an article within the void. The void has a length that may be considerably longer dimensionally than the thickness of the assembly. A longitudinal axis of the article is positioned parallel to the longitudinal axis of the void in which it is positioned.

DETAILED DESCRIPTION OF THE INVENTION

Figure 1:
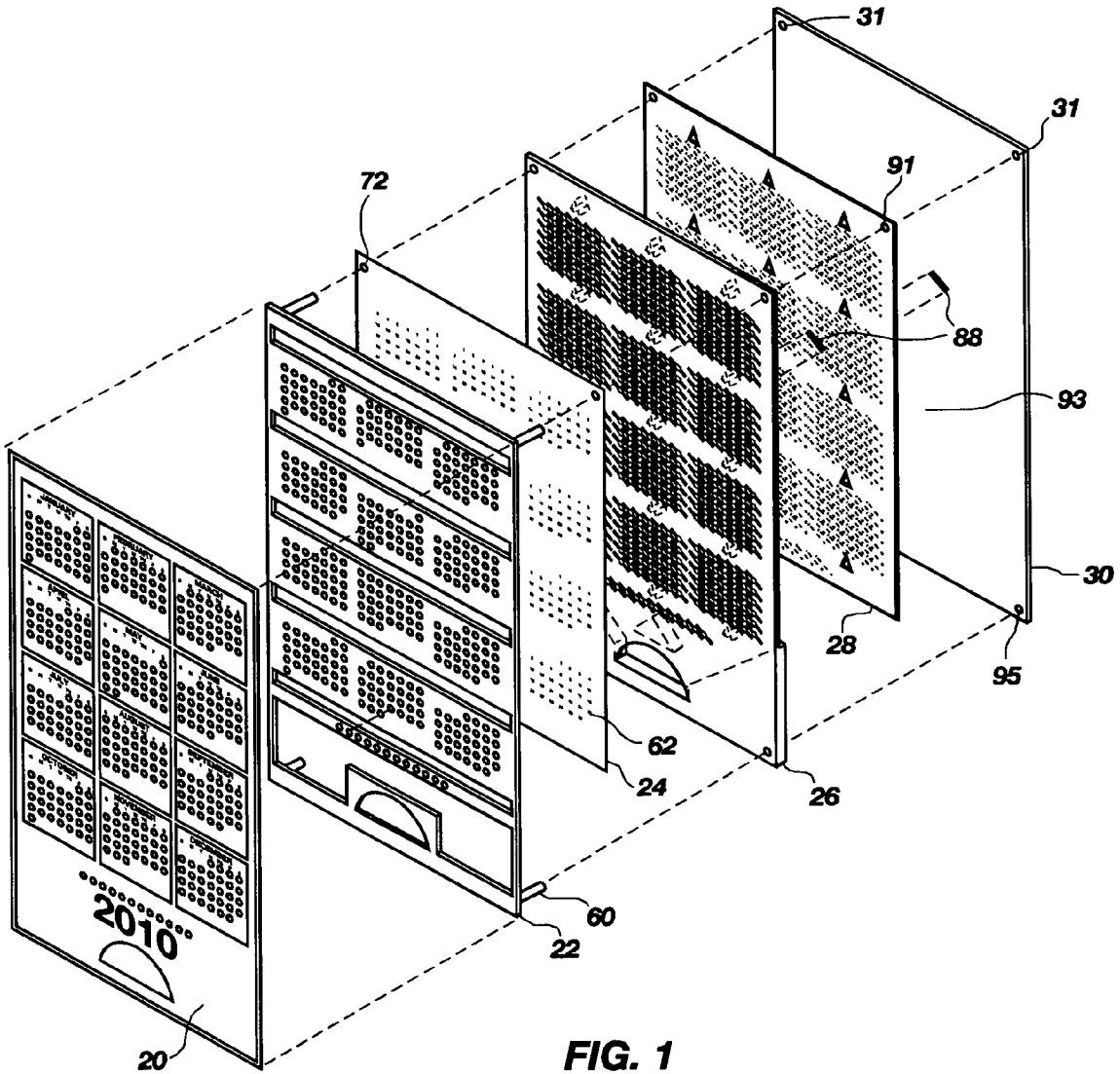
FIG. 1 is an exploded perspective view of a calendar in accordance with the instant invention.
Figure 2:
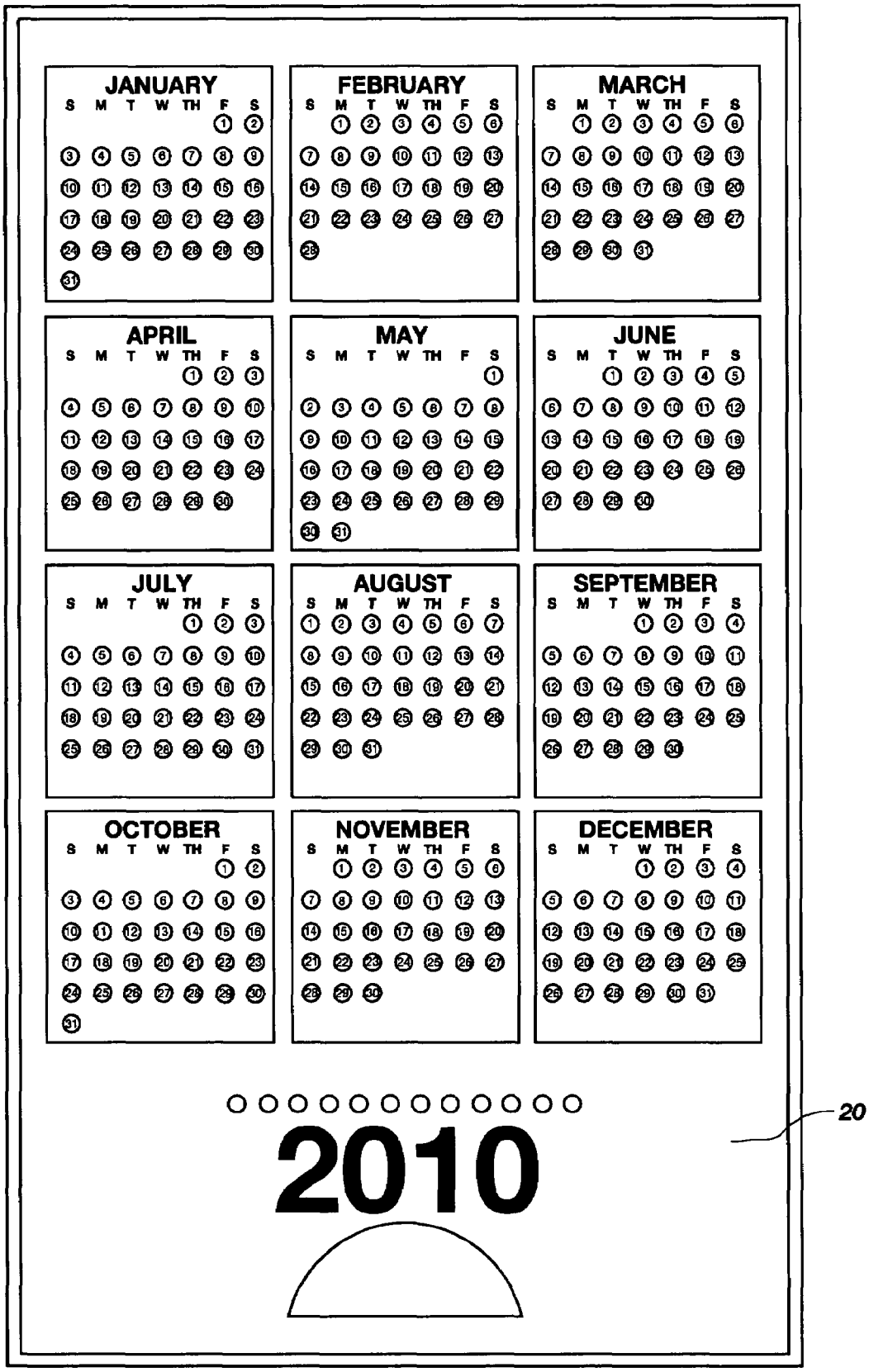
FIG. 2 is a front elevational view of the calendar assembly illustrated in FIG. 1.
Figure 17:
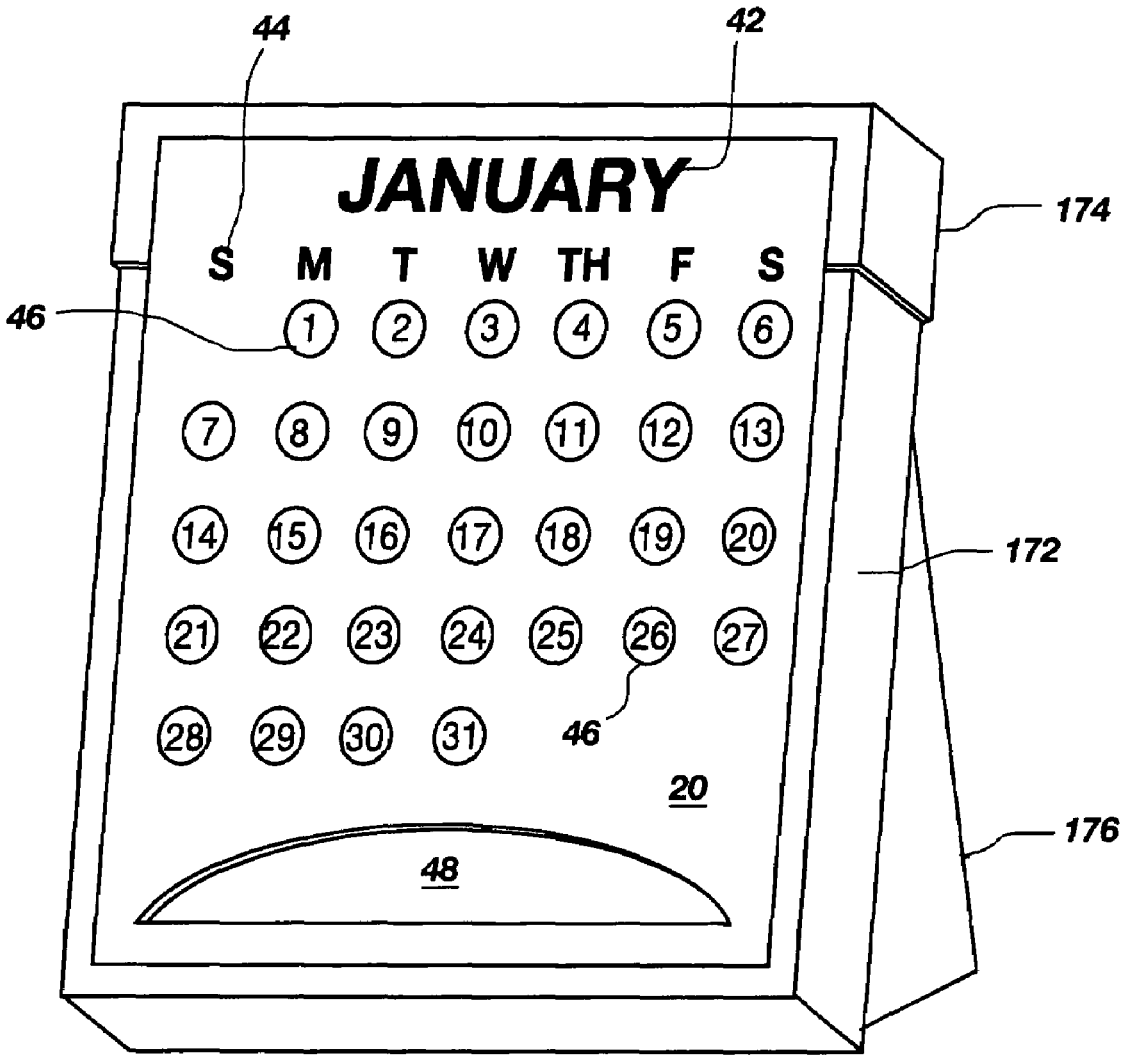
FIG. 17 is an alternate perspective view of a calendar assembly of the instant invention.

As shown in FIG. 1, a calendar of the instant construction may include six substantially planar substrate panels 20, 22, 24, 26, 28 and 30, each having a generally rectangular configuration. It should be understood that while FIG. 1 illustrates the various panels as having a rectangular configuration, alternative configurations may also be utilized in the invention, e.g., circular, oval, etc. Alternative constructions may include less than six panels, e.g., three panels. The association of six substrates may be housed within a cabinet structure configured to retain the substrates in a generally fixed orientation. In preferred constructions the panels are positioned generally upright and parallel to one another. An illustrative cabinet structure is shown in FIG. 17. Alternative cabinet or frame structures may include a simple frame positioned about the assembly of substrates. Each substrate has a planar front face and a planar rear face and four linearly configured sides. The material composition of each substrate may vary based on the specific function that the particular substrate is intended to perform.

Figure 3:
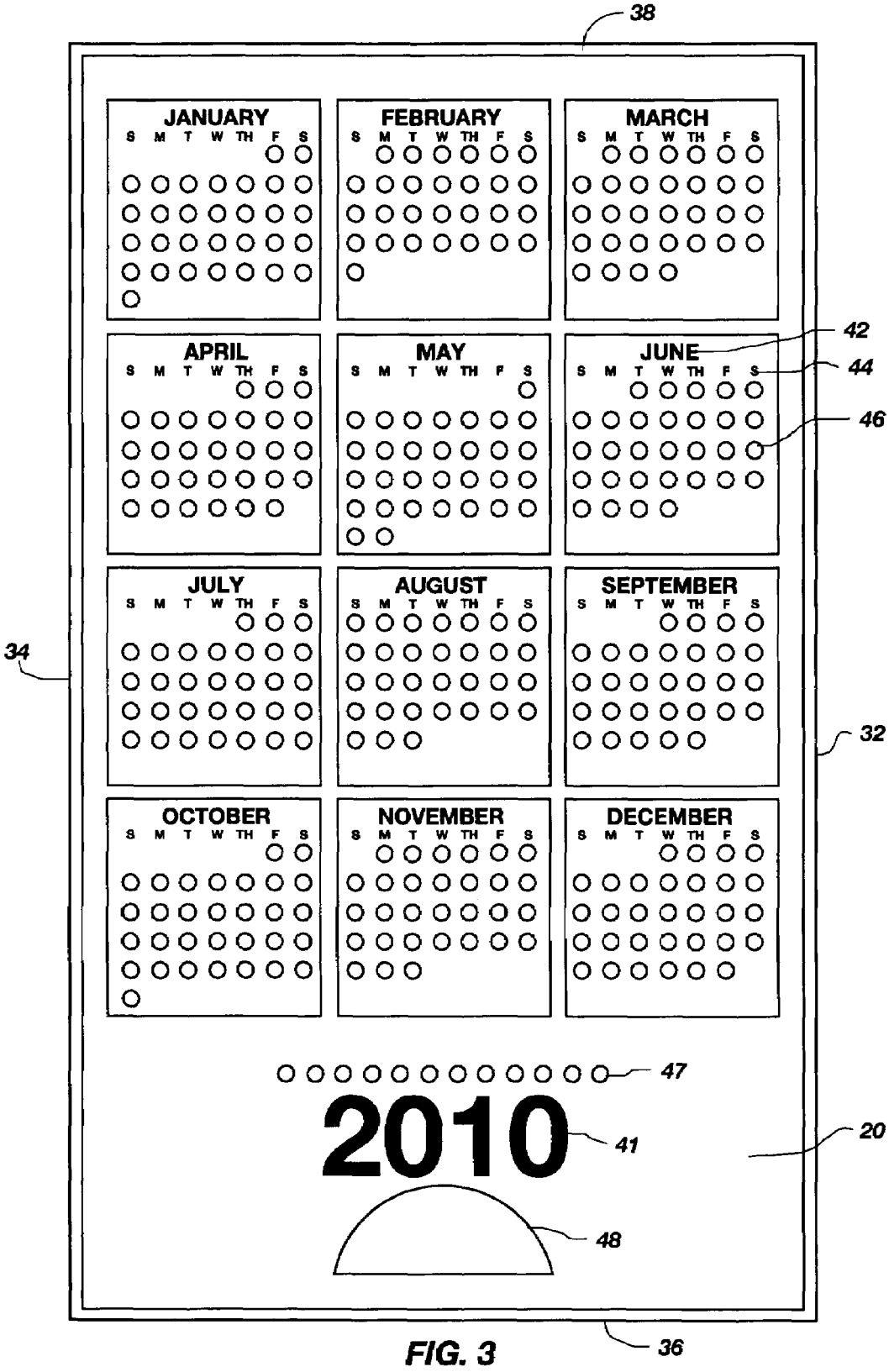
FIG. 3 is a front elevational view of the first substrate of the calendar assembly illustrated in FIG. 1.

The first substrate 20, as shown in greater detail in FIG. 3, may be formed of paper, plastic or other suitable material that is amenable to having printing applied to the surface thereof. The first substrate 20 has a bottom linear edge 36, two upstanding linear edges 32 and 34 and a top linear edge 38. As illustrated, the first substrate 20 may include a depiction thereon of one or more months in a traditional calendar arrangement. The name of the month 42, e.g., June, is identified at the upper region of the representation of each month. Positioned elevationally below the name of the month, in a horizontal array, is a letter 44 or other indication of the seven days of the traditional week. Positioned below the indications of the days is a plurality of circular openings 46 that are disposed in linear arrays of horizontal and vertical rows. Each of the days of the month is associated with a respective circular opening 46. The opening 46 extends through the entire thickness of the substrate 20. In the embodiment of the invention shown in FIG. 3, the representations of the months are themselves arranged in linear arrays, both horizontally and vertically.

The first substrate 20 may further include an indication of the year 41, e.g., 2010, as well as a series of auxiliary openings 47 positioned above the indication of the year, which also may be formed of a series of circular openings that extend through the complete thickness of the first substrate 20. Positioned near the lower edge 36 of the first substrate 20 is a large opening 48. This opening 48 also extends through the entire thickness of the substrate 20 and is dimensioned to permit a user to reach therein and collect an article, e.g., an entertainment message, deposited therein by the operation of the calendar.

Figure 4:
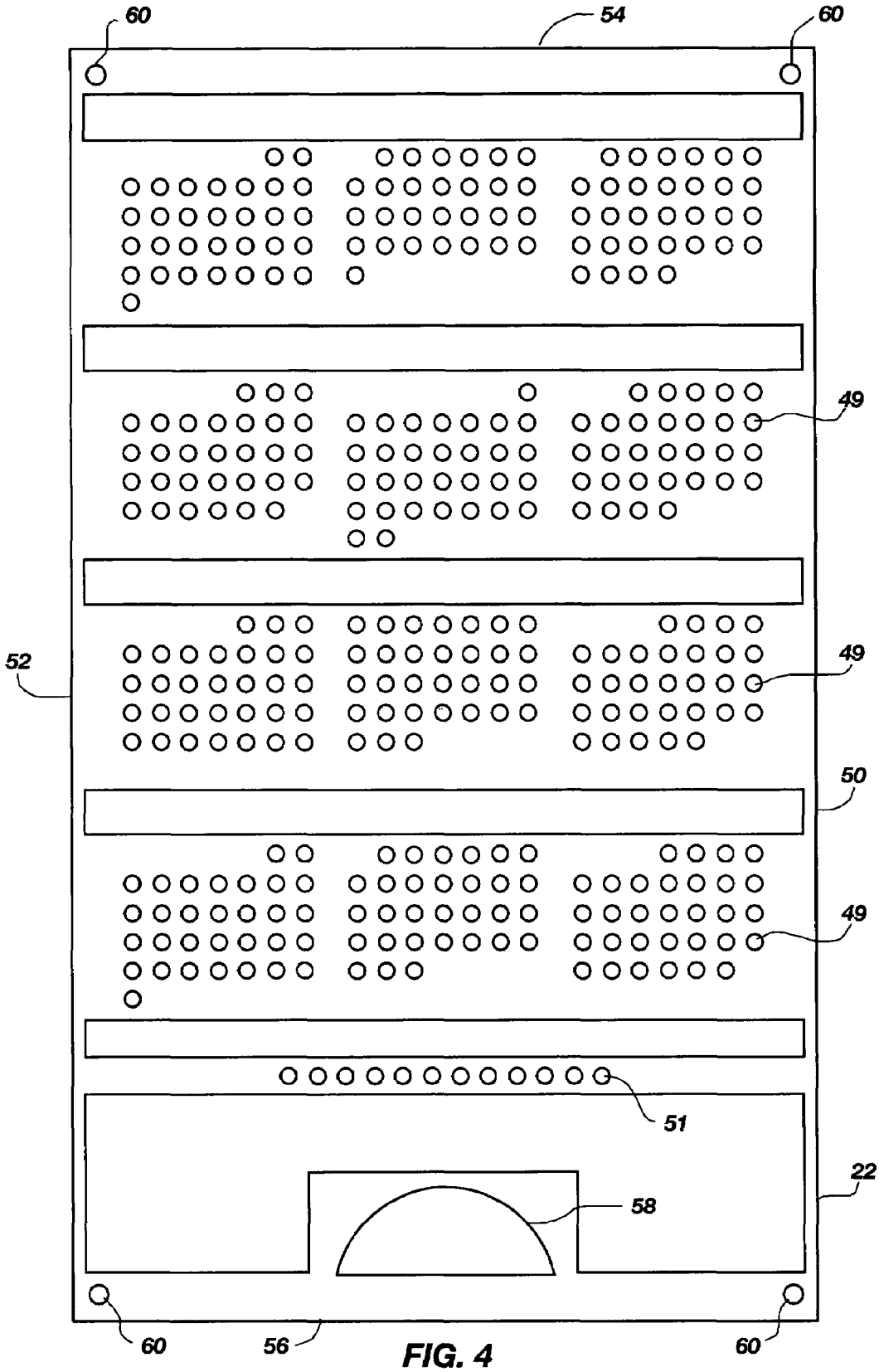
FIG. 4 is a front elevational view of the second substrate of the calendar assembly illustrated in FIG. 1.

The first substrate 20 is adhered or otherwise secured to the outer face of the second substrate 22. The second substrate, shown in FIG. 4, is a planar panel having an upper edge 54, two upstanding linear edges 50 and 52 and a linear bottom edge 56. The second substrate 22 is similar to the first substrate 20 in that it defines a plurality of circular openings 49 that extend through the entire thickness of the second substrate 22. These openings 49 are arranged similar to the arrangement of the circular openings 46 in the first substrate 20, i.e., in linear horizontal and vertical rows. The circular openings 49 are arranged to align with the circular openings 46 of the first substrate 20 when the two substrates are secured to one another.

It follows that when the two substrates are associated one to the other, each circular opening 46 is paired with a corresponding circular opening 49 to form a continuous channel that extends through the combined thickness of the two secured substrates 20 and 22. The second substrate 22 may also define a series of circular openings 51 that correspond to the circular openings 47 of the first substrate 20. Similarly, a large opening 58 is defined in the lower portion of the second substrate, proximate the lower edge 56, that corresponds both dimensionally and positionally to the opening 48 of the first substrate 20. The second substrate 22 is formed of a substantially rigid material that provides sufficient rigidity to the assembly to maintain the assembly substantially resistant to the forces applied thereto by a user who is engaged in pushing a dislodgement tool through the respective slots 130 that are positioned about the respective openings 46 and 49.

In those embodiments of the invention wherein the calendar is operated by the user using his or her finger instead of a dislodgement tool, the second substrate is sufficiently rigid to resist the forces directed against the calendar structure by the user's pushing on that portion 61 of the third substrate 24 that extends through openings 46 and 49, which identify the various days of the calendar.

Secured to the back face of the second substrate 22 is a plurality of spacer elements 60. As shown, these elements may be positioned proximate the four corners of the second substrate 22. These spacer elements 60 are dimensioned to pass through openings defined in the subsequently positioned three substrates 24, 26, and 28 and thereafter engage the sixth substrate 30 thereby defining a selected spacing of the fifth substrate 28 from the sixth substrate 30 sufficient to define a channel 150 (see FIG. 11). As shown, these spacer elements 60 may be formed of elongate cylindrical members that are secured on their first ends to the back face of the second substrate 22 and whose opposing ends engage respective receiving wells 31 defined in the sixth substrate 30.

Figure 5:
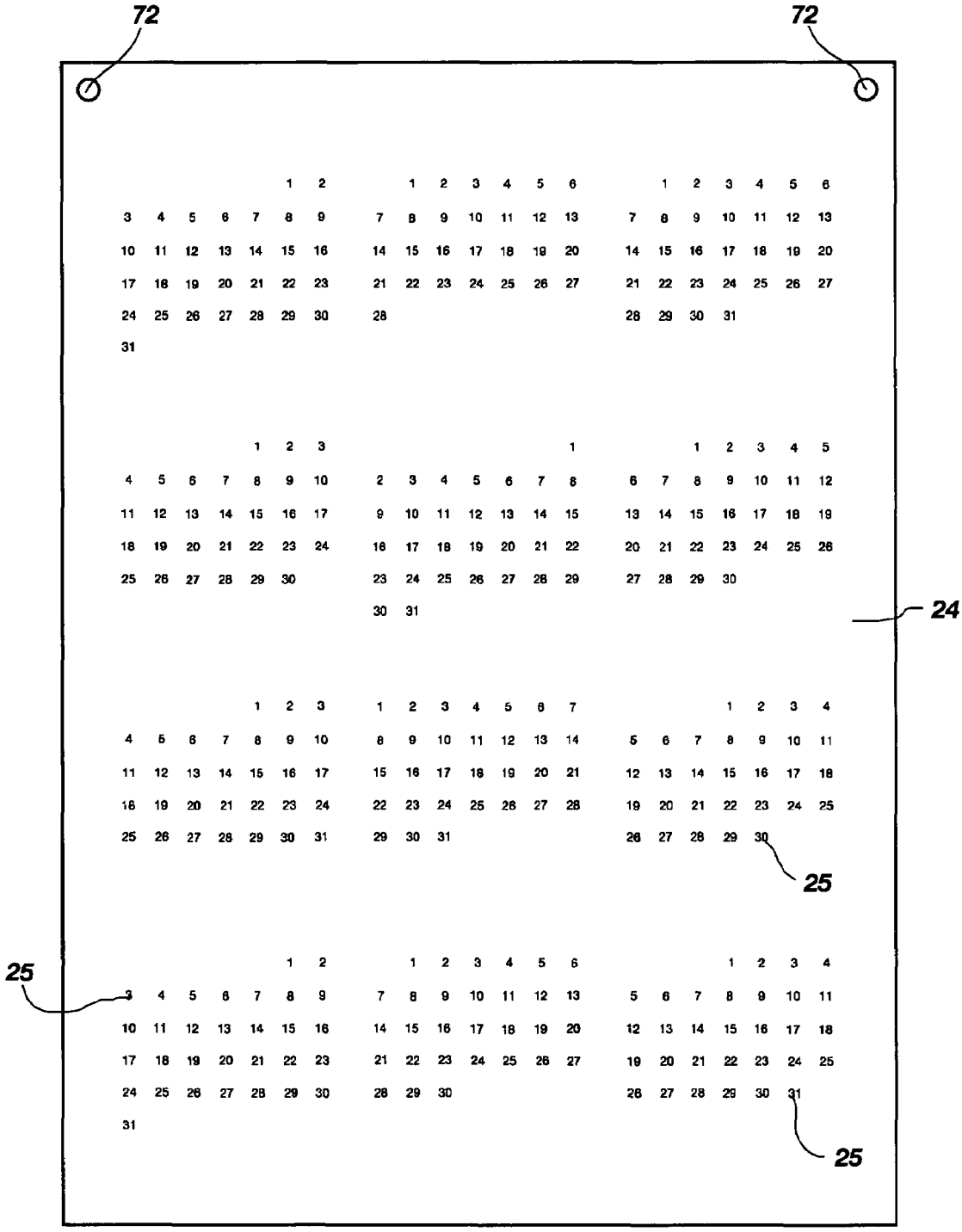
FIG. 5 is a front elevational view of the third substrate shown in FIG. 1.

The third substrate 24, as shown in FIG. 5, is formed of a thin rectangular sheet, which may be fabricated from a metal foil, plastic sheet, or other flexible material.

In other embodiments, the third substrate may be formed of thermoformed plastic or a silicone membrane. Alternative materials exhibiting similar characteristics to these materials may also be utilized. The front face of the third substrate includes a plurality of indicia, such as numbers 25, printed therein. The numbers 25 are arranged in linear arrays that are arranged both vertically and horizontally. Each of the numbers is positioned so as to align with a respective circular opening 46 and 49 of the two previously described substrates 20 and 22 when the three substrates are positioned adjacent one another. Furthermore the numbers 25 are dimensioned such that upon assembly of the calendar each of the numbers 25 is clearly visible through its respective circular opening defined by opening 46 and 49.

Figure 12:
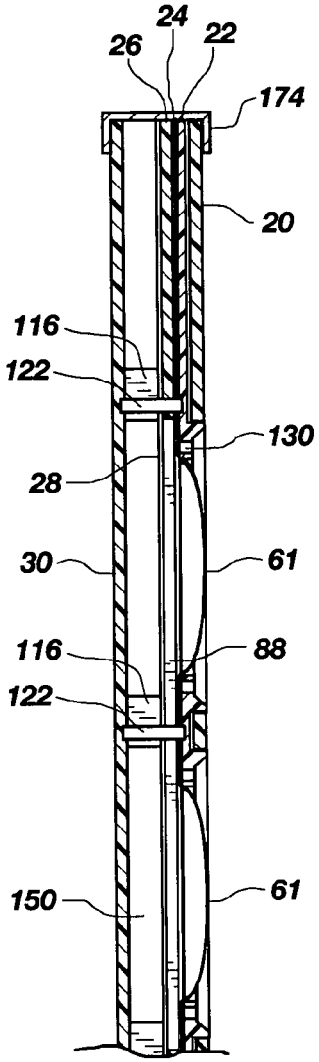
FIG. 12 is a cross-sectional view of the Calendar of FIG. 1 with a top cabinet structure positioned thereon.
Figure 12A:
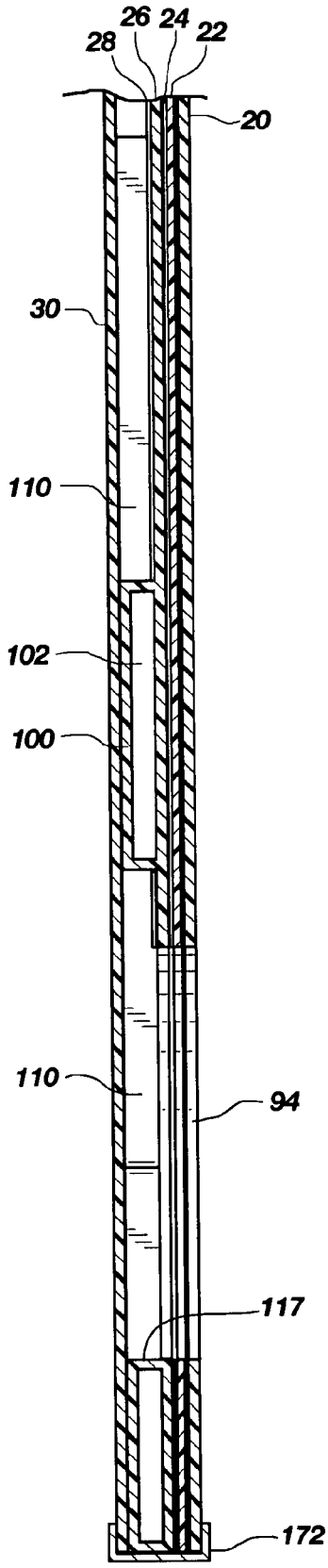
FIG. 12A is a continuation of the cross-sectional view of FIG. 12.

In a preferred construction, the front face of this substrate 24 is secured to the rear face of the second substrate 22 whereby the sheet extends through each of the openings 46 and 49 to form a semi-spherical configuration 61 as shown in FIG. 12. This configuration may be produced by applying a vacuum to the outer face of the first substrate 20 during the assembly process either during or subsequent to the assembly of the first three substrates.

As can be seen in FIG. 1, the third substrate 24 is dimensioned to have a height that is less than the first two substrates. When the third substrate is secured to the back face of the second substrate 22 the lower edge of the third substrate is positioned at a location slightly below the horizontal array of circular openings 51 thereby leaving the lower portion of the back face of the second substrate 22 exposed. The third substrate may be adhered to the back surface of the second substrate using a conventional adhesive.

Figure 6:
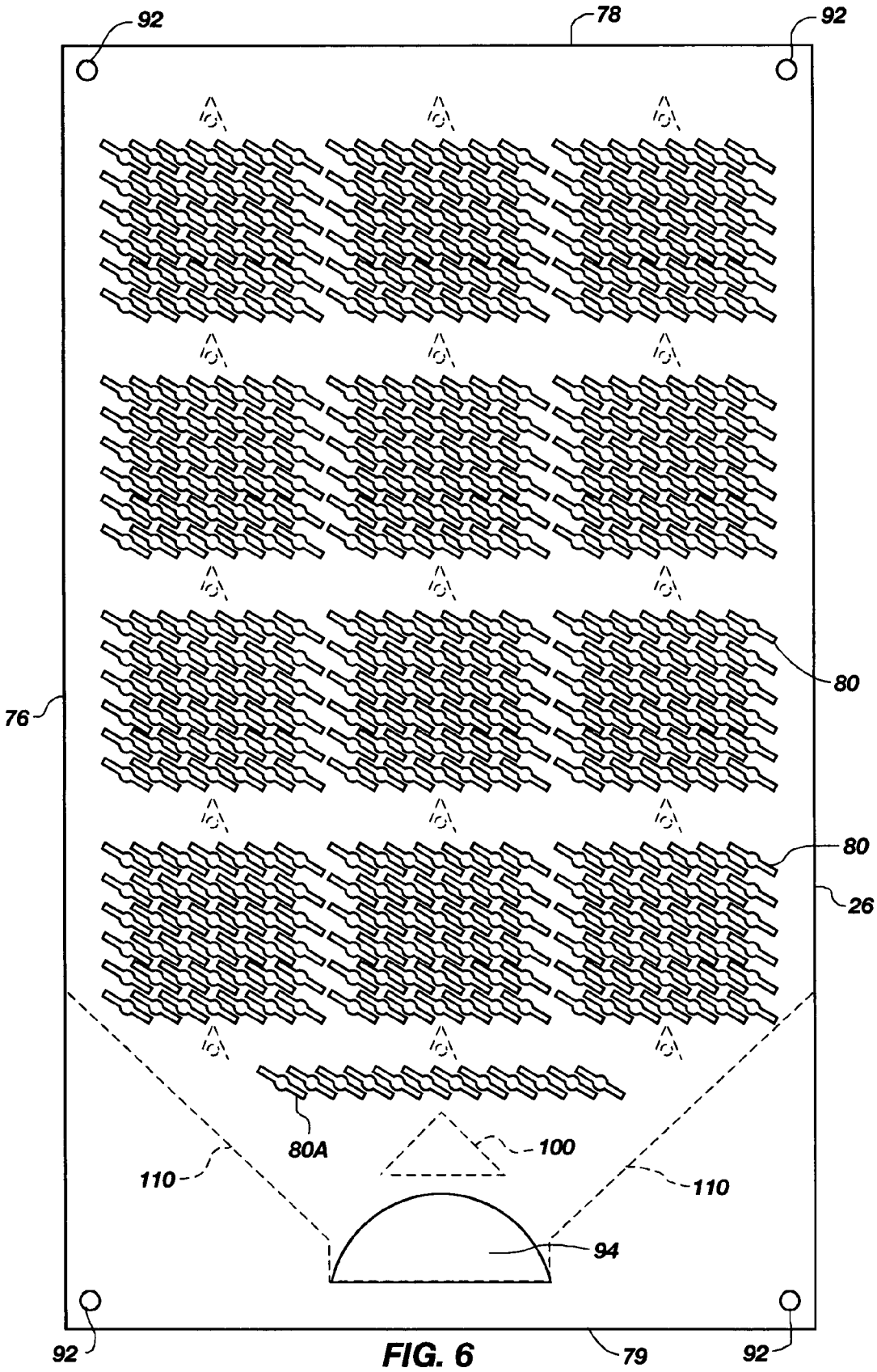
FIG. 6 is a front elevational view of the fourth substrate shown in FIG. 1.
Figure 9:
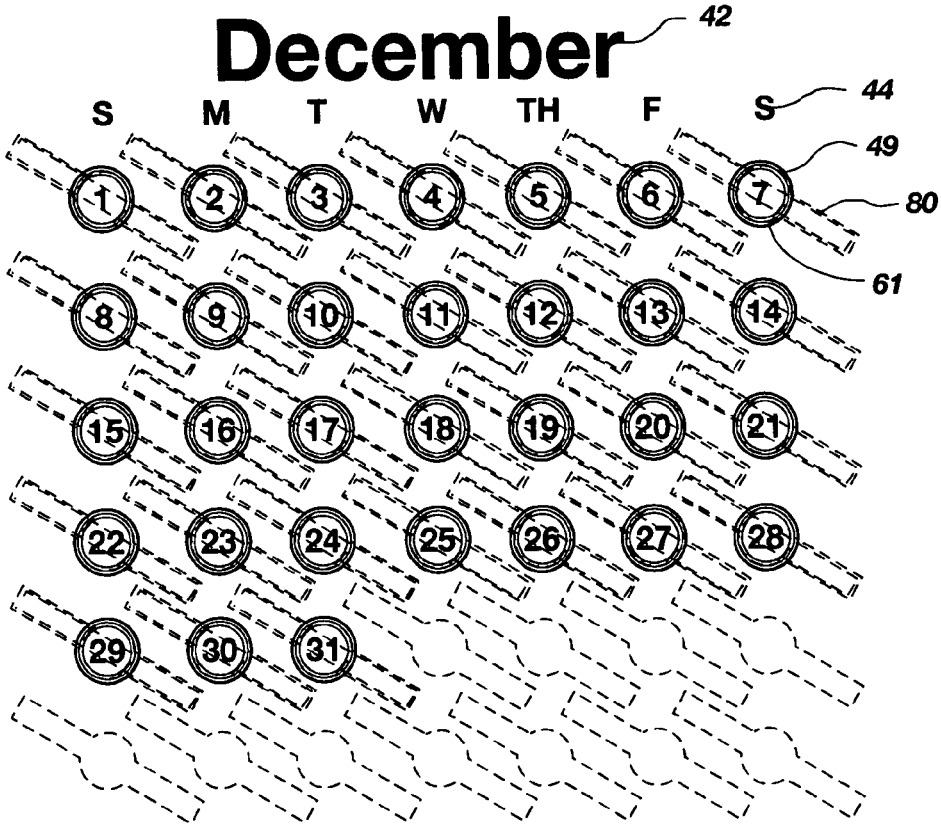
FIG. 9 is a sectional view of the calendar of FIG. 1.
Figure 9A:
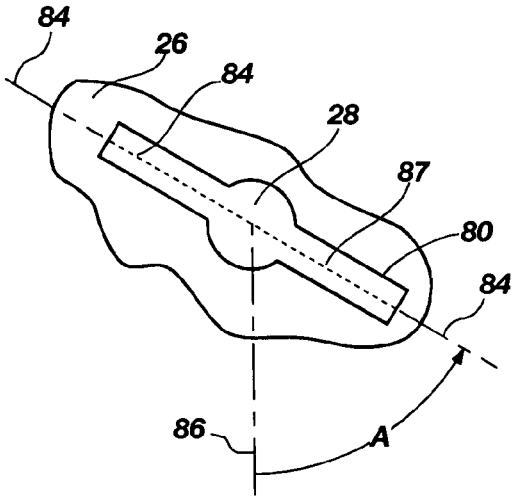
FIG. 9A is a sectional front view of the fourth and fifth substrates shown in FIG. 1.
Figure 9B:
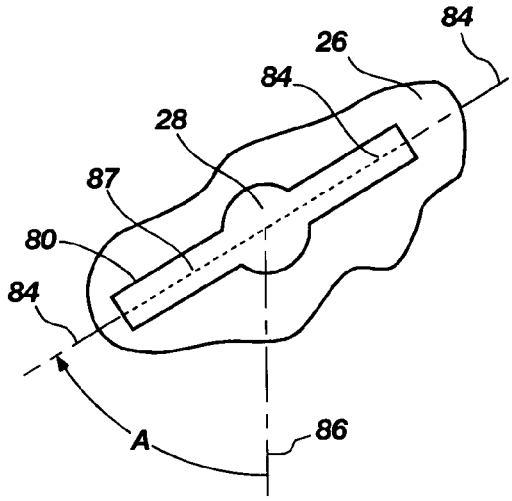
FIG. 9B is a sectional front view an alternative embodiment of the fourth and fifth substrates shown in FIG. 1.

As shown in FIG. 6, the fourth substrate 26 defines a plurality of openings or cavities 80 therein that may be viewed as being formed of an elongated rectangular opening in association with a circular opening positioned proximate the center of the rectangular opening. Each of these openings 80 defines a longitudinal axis 84 that is oriented at an angle A to the vertical 86, as shown to advantage in FIG. 9A. This angle A is defined clockwise from the vertical as shown in FIG. 9A. Preferably, the angle A is approximately 30 degrees, however, the angle may be any degree measure within the range of 5 degrees to 85 degrees. A preferred range is 15 to 60 degrees with a very preferred range being between 15 and 45 degrees. FIG. 9B shows an alternative embodiment of the invention, wherein the orientation of the opening 80 has been shifted by 90 degrees. In this embodiment, the angle A is defined counterclockwise from the vertical. In this alternative embodiment, the angle A may likewise be preferably 30 degrees. The preferred ranges identified for the embodiment of FIG. 9A are equally applicable to the embodiment shown in FIG. 9B. The openings 80 are arranged in linear arrays of horizontal rows and vertical rows to form the various groupings shown in FIG. 6. Each of the openings 80 is configured and positioned to align with a respective association of an opening 46 and an opening 49 in the first 20 and second substrate 22.

The orientation of the openings 80 such that their longitudinal axes are positioned parallel to the surface of the substrate 26 facilitates the construction of a calendar that is markedly reduced in thickness. In prior calendar constructions wherein the article to be dispensed was oriented perpendicular to the surface of the calendar, the thickness of the calendar often exceeded 4 ¼ inches. This assumes an article length of approximately 2 inches. In the instant invention, with the article 88 oriented essentially parallel to the surface of the calendar, the thickness can be reduced to approximately ¾ inch while dispensing the same length article, resulting in a calendar thickness reduction of almost 83%. This reduction permits the construction of calendars having greater usefulness.

Figure 7:
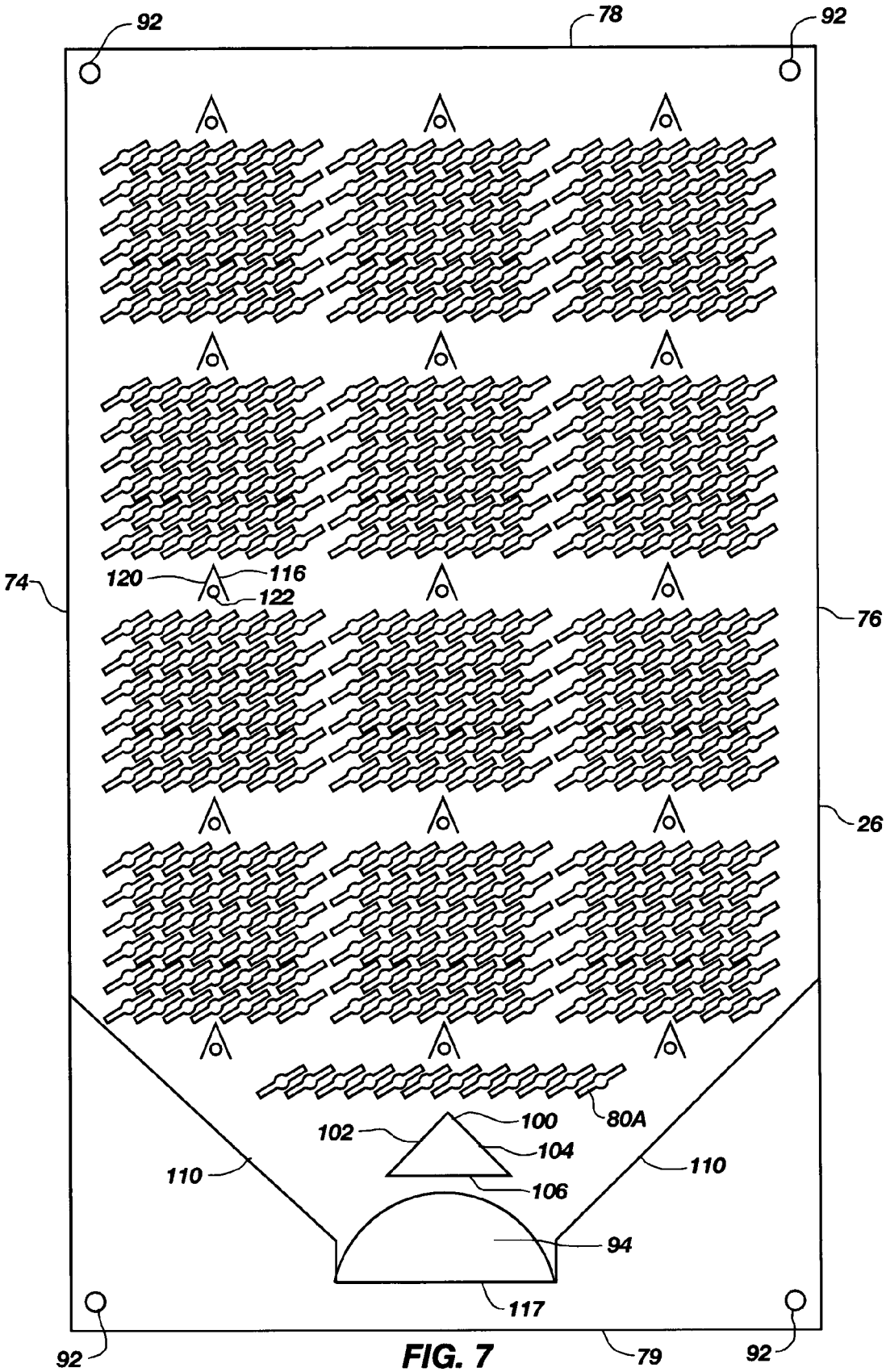
FIG. 7 is a rear elevational view of the fourth substrate shown in FIG. 1.

FIG. 7 illustrates the rear surface of the fourth substrate 26. As shown, the substrate defines an upper linear edge 78, two upstanding linear edges 74 and 76 and a linear bottom edge 79. The corners of the substrate 26 define an opening 92 that is dimensioned to receive a respective spacer 60. A plurality of guide members 116 are shown positioned on the rear surface of the substrate 26 to extend outwardly away from the rear surface of the substrate, Each guide member and support 116 may be formed of an inverted "V"-shaped element 120 in association with a cylindrical element 122 that is adhered on its first end to the rear surface of the substrate 26. In alternative constructions the element 116 may be configured differently. For example, the element 116 may be configured solely as a cylindrical element 122.

Each of the guide and support members 116 is positioned proximate a respective grouping of openings 80 and functions to direct articles that are dislodged from those respective openings downwardly to the collection opening 94. A triangular guide member 100 formed of three panels 102, 104 and 106 is shown positioned elevationally below the series of openings 80A. This guide member 100 is adapted to direct articles dislodged from the various openings 80 and 80A to the opening 94 defined in the substrate 26. Guide member 100 may be omitted from certain embodiments of the invention. The fourth substrate also defines a laterally extending, angled ramp 110 on each side of the opening 94. Each of the ramps 110 on its lowermost end connects to a laterally extending, horizontally positioned shelf 117. The shelf 117 is positioned proximate the lower edge of the opening 94. Ramp 110 may be omitted from certain embodiments of the invention.

FIG. 6 illustrates the spatial relationship of the openings 49 of the second substrate, the indicia labeled semi-spherical portions of the third substrate and the voids 80 defined within the fourth substrate 26. As can be noted in FIGS. 9 and 9A, the circular openings 49 align with the circular portion of the recess void 80 while the elongate portion of each opening 80 extends outwardly from the aligned portions of the openings 49 and 80.

Figure 10:
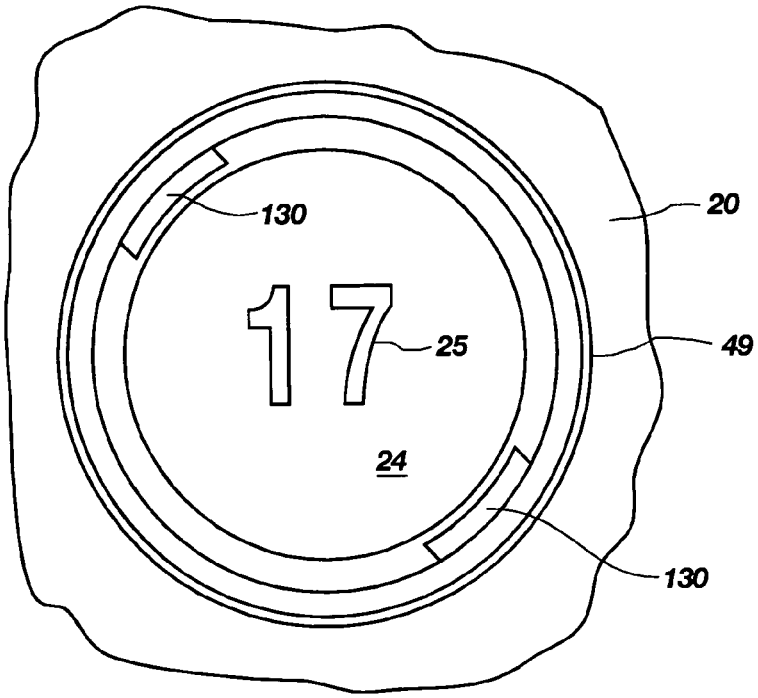
FIG. 10 is a sectional view of the Calendar shown in FIG. 1.
Figure 11:
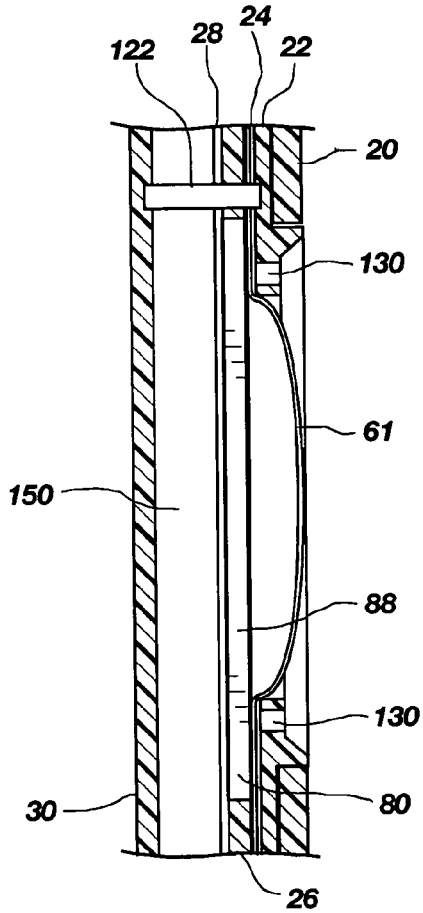
FIG. 11 is a cross-sectional view of the Calendar shown in FIG. 1.

FIGS. 10 and 11 illustrate an embodiment of the invention, wherein a tool is used to dislodge the compacted web 88 from its void 80. In this embodiment, each opening 49 is associated with a means of facilitating the operation of such a tool. As shown in FIGS. 10 and 11, a single opening 49 is associated with its respective semi-spherical portion 61 of substrate 24. The second substrate 22 defines a pair of slot openings 130 positioned diametrically spaced from one another. These slots 130 extend through the thickness of the second substrate 22 and are configured to permit the user to insert the arms of a tool through the slots and by subsequently pressing the tool against the substrate 24 positioned adjacent the substrate 24 apply a laterally directed force against the substrate 24 sufficient to dislodge rearwardly a message strip 88 positioned within the recess well 80 defined within the fourth substrate 26. In this particular embodiment, the arms of the tool may actually rupture the substrate 24 as they exert a lateral force on the message strip 88.

Alternatively, the user may dislodge the message strip 88 from its void 80 by applying a lateral force directly to the message strip 88 by pressing the portion 61 of the substrate 24 with the user's finger or another object.

Figure 8:
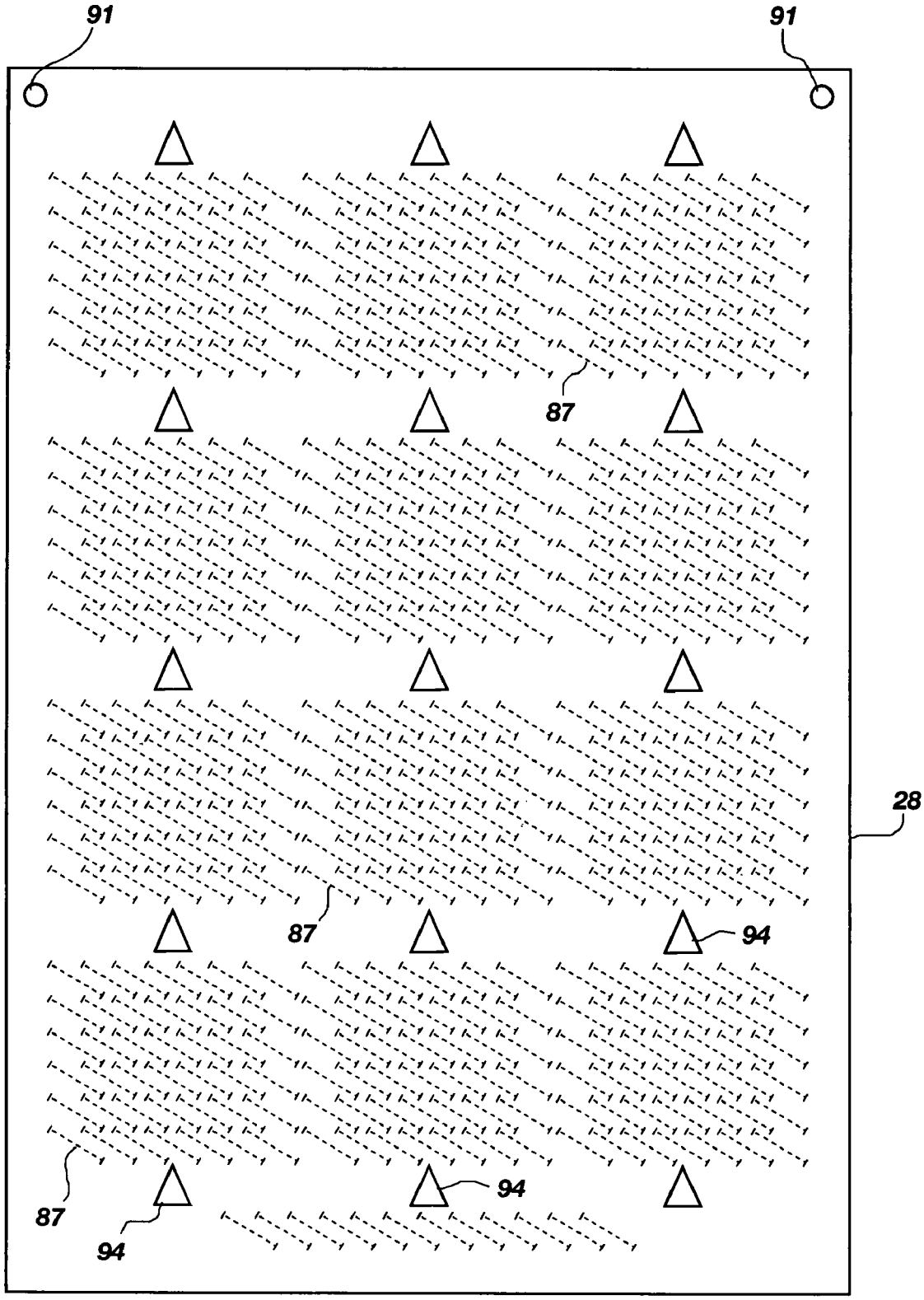
FIG. 8 is a front elevational view of the fifth substrate shown in FIG. 1.

The fifth substrate 28 is secured to the rear face of the fourth substrate 26 and defines a series of triangular openings therein dimensioned to permit the passage there through of the guide members 116 and 100. Further, in preferred constructions, the substrate 28 includes a plurality of perforation or score marks 87. These perforation marks are configured to be parallel to the longitudinal axis of the message strip 88 when the strip is in its folded condition. The perforation marks 87 and the longitudinal axis of the strip 88 are positioned to align in parallel with the longitudinal axis 84 of each of the openings 80 in the fourth substrate 26 when the fourth substrate 28 is secured to the rear surface of the fifth substrate and the message strip is positioned within its respective cavity. In a preferred construction the perforation marks 87 are constructed to include a principal longitudinally positioned perforation mark in association with a pair of perpendicularly oriented perforation marks, one perpendicularly oriented perforation mark being positioned on each of the opposing ends of the principal perforation mark as shown to advantage in FIG. 8. The fifth substrate 28 also defines openings 91 proximate the corners thereof dimensioned to receive the spacer elements 60.

The sixth substrate 30 is formed of a rectangular panel having a front planar surface 93. This substrate 30 defines a plurality of receiving wells 95, positioned proximate the corners of the substrate 30 adapted to receive and retain the spacer elements 60. The spacer elements 60 function to position the front surface 93 spacedly from the rear surface of the fifth substrate 28 thereby defining a plenum 150 between the fifth and sixth substrates. This plenum 150 defines a passageway for articles that are displaced from their retaining cavities 80 and through the fifth substrate by the user.

Figure 13:
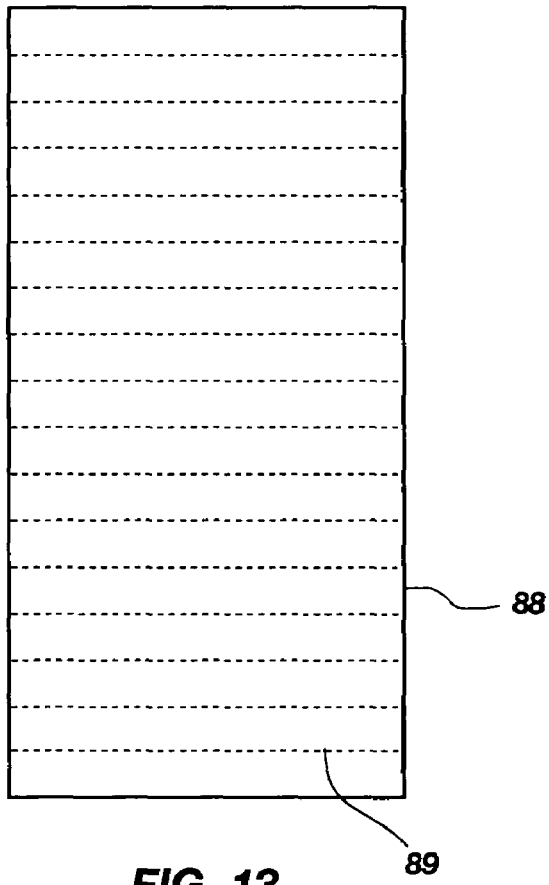
FIG. 13 is a plan view of a message strip.
Figure 14:
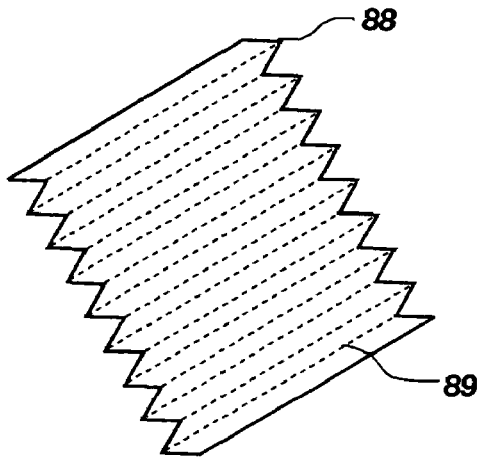
FIG. 14 is a perspective view of the message strip of FIG. 13 shown in a partially folded configuration.

FIGS. 11 and 12 illustrate a side sectional view of the calendar assembly that shows the plenum 150. FIGS. 13 and 14 illustrate a message strip or web 88 that is configured to be housed within the cavity 80 of substrate 26. As shown, the message strip 88 may include a rectangular sheet of paper that is perforated, scored or otherwise adapted to permit the folding of the strip along lines that are generally perpendicular to the longitudinal axis of the strip to thereby form the accordion configuration shown in FIG. 14. The folded strip may thereafter be further processed to form a generally boxlike element having a rectangular cross-section that may then be positioned within a respective cavity 80 defined within the substrate 26.

Figure 15:
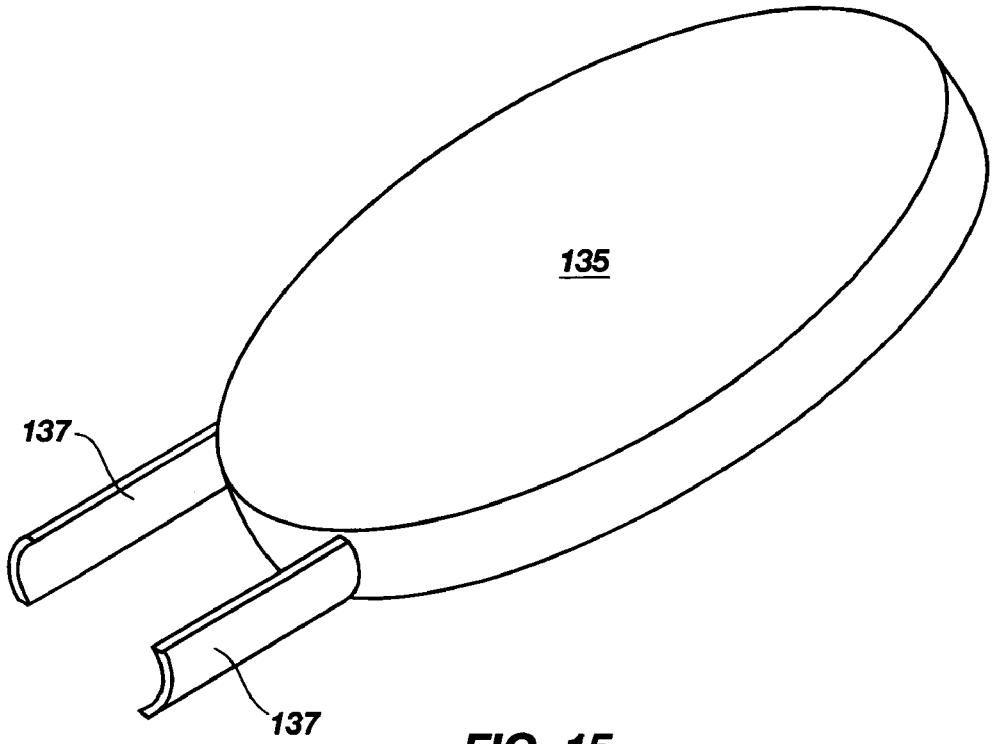
FIG. 15 is a perspective view of an apparatus for dislodging the paper rolls from their respective retaining channels in the calendar assembly of FIG. 1.
Figure 16:
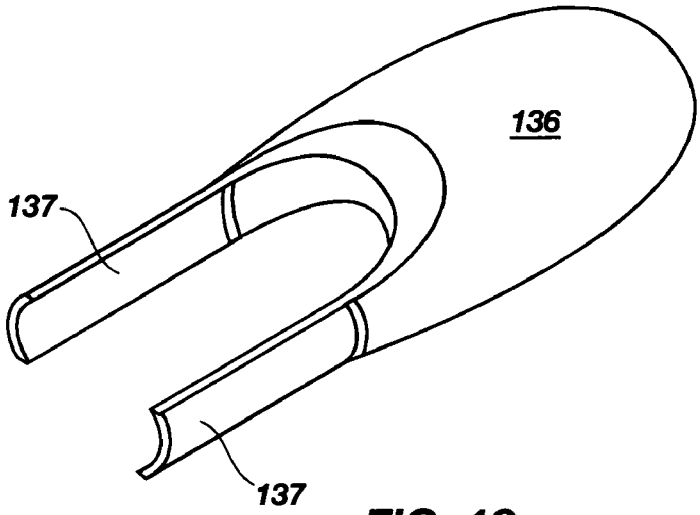
FIG. 16 is a perspective view of an alternative apparatus for dislodging the paper rolls.

FIGS. 15 and 16 illustrate two dislodgement tools that may be utilized by the user to dislodge the articles 88 from the recess wells 80. As shown, each tool includes a pair of outwardly extending, parallel radiating arms 137 that are dimensioned to be received within the slots 130. The arms 137 are fixedly connected to a handle section 135, 136 that is graspable by the user.

It should be noted that in the instant calendar construction, the use of dislodgement tools whose operative arms are received in preformed slots 130, permits the use of the calendar without actually destroying the portion 61 of substrate 24 that extends through openings 46 and 49. It follows that the aesthetic appearance of the calendar is not altered as the month progresses and the individual articles are dispensed from the calendar. Furthermore, in those embodiments of the calendar wherein the operation of the calendar is activated by the user pushing directly on the portion 61 of the substrate, the portion 61 is likewise not ruptured or otherwise damaged, thereby preserving the aesthetics of the calendar's appearance. Furthermore, in some of the versions of the calendar in which the user directly pushes the portion 61, the need for a fourth and fifth substrate 28 may be eliminated by adhering the message strips 88 directly on the back of the third substrate 24 by means of a weak adhesive.

FIG. 17 is a perspective view of an alternative construction of the calendar wherein a single month is shown as opposed to an arrangement of twelve months. The calendar is shown within a frame or cabinet 172 having a cap section 174 that covers the upper region of the frame. The cap section 174 may be configured to be manually removable from the frame for purposes of permitting the user to change the individual calendar element that is displayed in the frame. The frame 172 is supported in an upright position through the assistance of a support 176, which is mounted on the rear portion of the frame 172.

Figure 18:
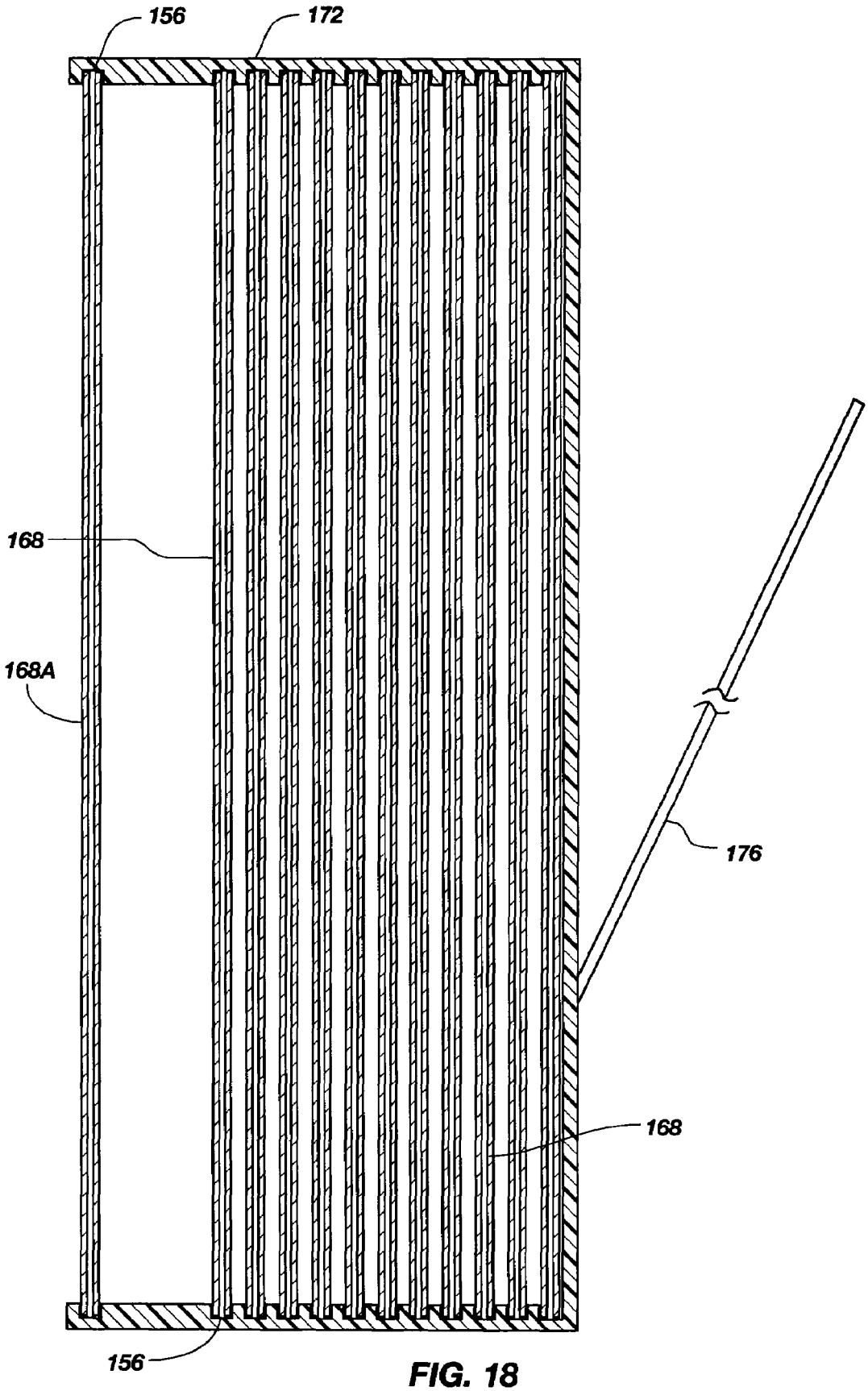
FIG. 18 is a top view of the calendar assembly of FIG. 17 with the top of the cabinet being removed.

FIG. 18 is a top view of the calendar assembly of FIG. 17, with the top of the cabinet frame being removed, which illustrates the placement of the various calendar elements 168. Each of these elements 168 are retained within a pair of slots 156 defined within the internal sidewalls of the frame 172. As shown, each of the elements 168 extend between a respective pair of slots 156 and is retained thereby within the frame. The interior of the frame 172 may be accessed by removing the cap section 174 whereby, the user may simply pull the foremost calendar element 168A upward until it is disengaged from its respective pair of slots 156. Thereafter, the user may retrieve another calendar element 168 from the collection of remaining elements 168 housed within the frame and subsequently position this second calendar element in the position previously occupied by the foremost calendar element 168A. Each of the calendar elements 168 shown in FIG. 18 is formed from an assembly of substrates 20, 22, 24, 26 and 28. It is contemplated that substrates 26 and 28 may also be omitted from certain embodiments of the invention, for instance, in those embodiments which utilize a weak adhesive to secure the compressed web to the back of the substrate 24.

The embodiment of FIGS. 17 and 18 provides several practical benefits among which is the opportunity to provide the user with monthly or quarterly calendar elements 168 for insertion into the calendar cabinet structure. This permits the calendar supplier to provide up to date information printed on the articles to be dispensed. It follows that this embodiment constitutes a significant marketing opportunity and value for the calendar supplier.

Figure 19:
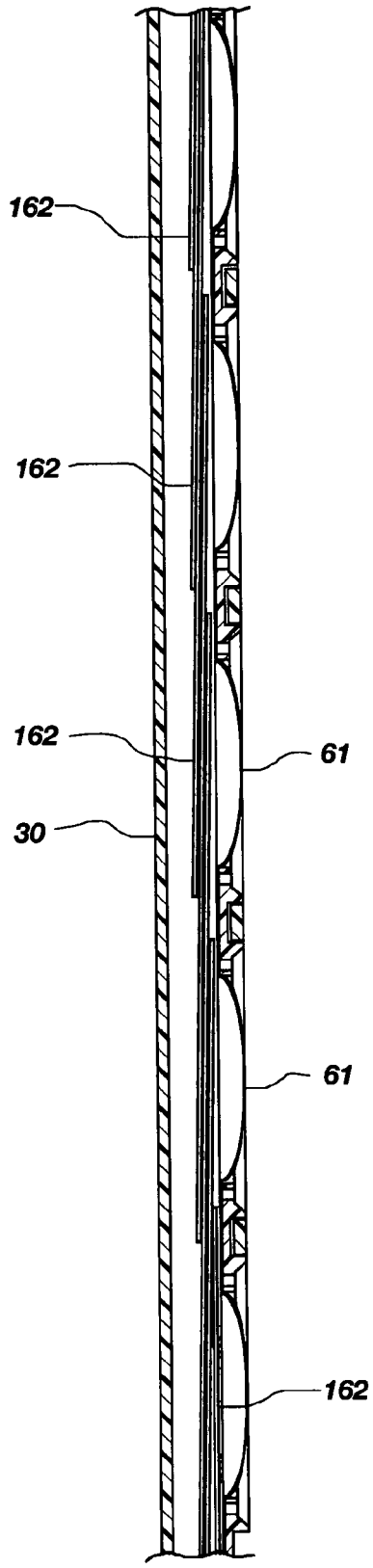
FIG. 19 is a cross-sectional side view of an alternative embodiment of the calendar of FIG. 1.
Figure 20:
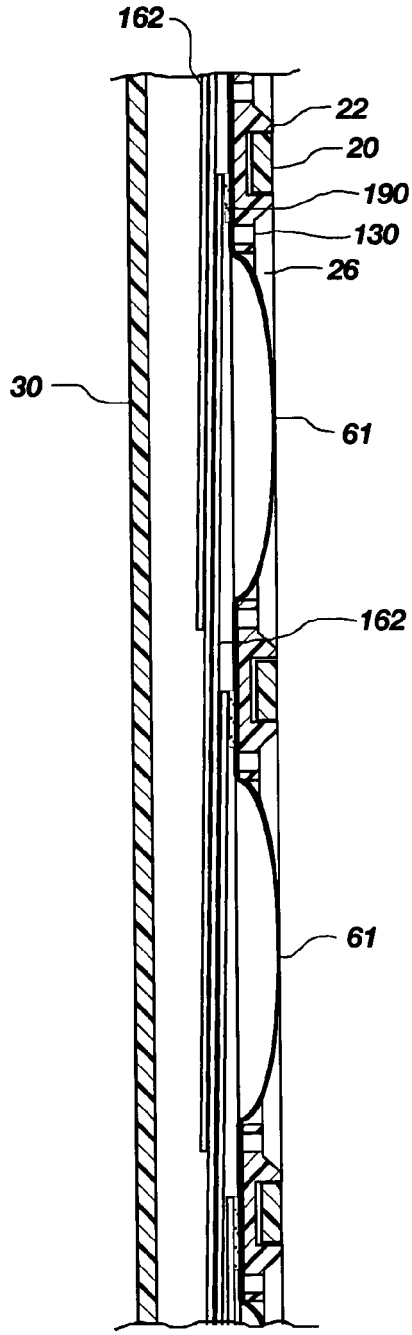
FIG. 20 is a cross-sectional side view of the alternative embodiment of the calendar of FIG. 1 as shown in FIG. 19.
Figure 21:
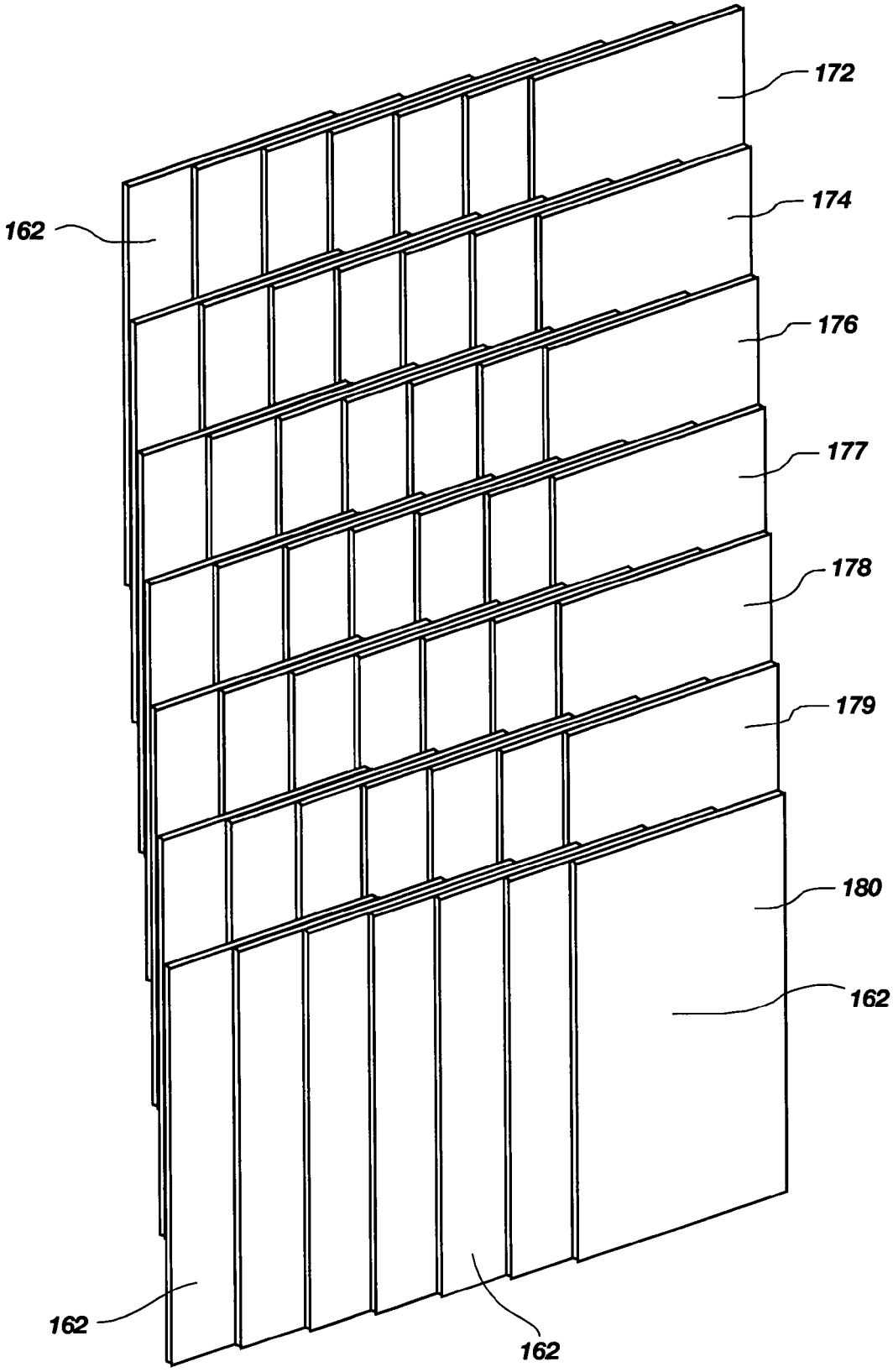
FIG. 21 is a perspective view of a collection of message strips from the calendar shown in FIG. 19.

FIGS. 19 through 21 illustrate an alternative construction of the calendar wherein the fourth and fifth substrates are replaced by a construction wherein a series of planar message panels 162 are selectively adhered to the rear surface of the third substrate 24. Each panel 162 is adhered to the third substrate proximate the perimeter of a respective opening 49 with a weak adhesive such that upon the passage of the arms 137 through the slots 130 the respective panel is disengaged from the third substrate 26 to thereafter fall downward to the collection opening 48 through the plenum 150. A shown in FIG. 21, the panels 162 are arranged in vertical rows as well as horizontal rows. Each panel is overlapped by an adjacent panel proceeding from right to left along each horizontal row as shown in FIG. 21. Furthermore, each panel 162 is overlapped by an adjacent panel 162 proceeding from the bottom of the panel assembly to the top of the assembly along each vertical row, as also shown in FIG. 21. The overlapping of the adjacent panels is further illustrated in FIGS. 19 and 20 in an overlapped orientation.

Figure 22:
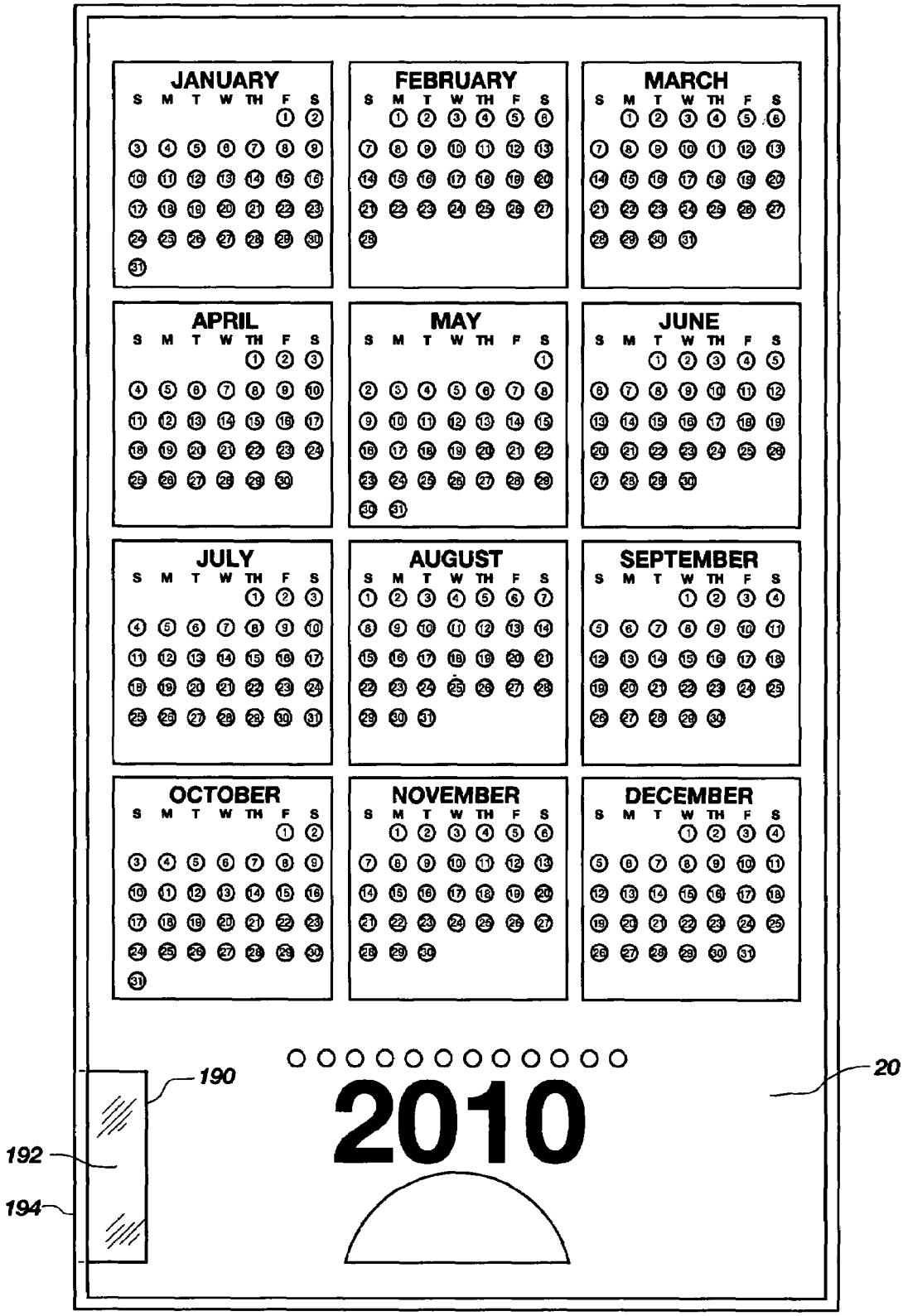
FIG. 22 is a front view of another embodiment of the invention.

FIG. 22 illustrates a further embodiment of the invention, wherein the foremost substrate of the calendar is fitted with a decoder 190. The decoder includes a colored transparent panel, which may be fabricated of plastic. In this embodiment, the substrate 20 and 22 are configured to define a void that is positioned directly behind the plastic panel 192. The void is configured to receive and retain an article 88 that is inserted therein. This void is accessible through a vertical slot 194 that is defined within the frame 172. In this embodiment, the article 88 may be imprinted with a message or other indicia that is decipherable by positioning it within the void such that the user may observe the article through the plastic panel 192. The message or other indicia may be imprinted or otherwise applied to the article 88 utilizing one of many inks or other writing mediums whose appearance only becomes visible to the human eye when it is observed through a specially colored transparent panel 192. Such technology is disclosed in the game DOUBLE TALK by Boyle & Elggren, Inc.

OPERATION

In operation, as each time period, e.g., a day, occurs, a user of the calendar may use the dispensing tool by inserting the arms 137 of that tool through the slots 130 of the calendar. As the arms either enter the recess well 80 by passing through the substrate 24, the arms engage an information carrying article, e.g., a message strip 88, positioned within that recess well 80. By applying sufficient force to the tool the article 88 is pushed through the respective perforated region of the fifth substrate 28. The article 88 is thereby displaced outward from the rear surface of the fifth substrate into the plenum 150. The article 88 thereafter falls downward through plenum 150 under the force of gravity. The falling article 88 is directed by guide elements 100 and ramp 110 to the opening 48 where it may be retrieved by the user.

In those embodiments that do not utilize a dispensing tool for their operation, the user may press on the semicircular cross-sectioned portion 61 of the substrate 24 that extends outward through the opening formed by openings 46 and 49, which corresponds to the selected day. As pressure is applied to the portion 61, force is applied to the message 88 sufficient to displace it rearwardly and outwardly through the substrate 28. Thereafter, the message 88 passes into the plenum 150 and subsequently to the opening 48.

While the above description contains many specific details as to construction of the invention, it should be appreciated that the invention is subject to many modifications, and is therefore, accordingly the full and true scope of the invention should be determined only by the appended claims and their legal equivalents.

What is claimed is:

1. A calendar comprising:

a primary substrate having front and rear surfaces, said front defining indicia which identify a month and the associated days of said month, said primary substrate having an array of spaced holes there through, each said hole being associated with a respective indicia for a said day;

a secondary planar substrate positioned proximate said primary substrate, said secondary substrate defining a plurality of elongate cavities therein, each cavity having a longitudinal axis oriented parallel to a front surface of said second substrate, each said elongate cavity communicating with a respective said hole;

a plurality of compacted webs, each said compacted web having a longitudinal axis associated therewith, each said compacted web being positioned within a respective said elongate cavity, wherein the longitudinal axis of said compacted web is oriented parallel to said longitudinal axis of said elongate cavity;

a tertiary substrate positioned adjacent said secondary substrate to retain said compacted webs within their respective elongate cavities; and a collection chamber disposed adjacent said tertiary substrate for receiving at least one said compacted web subsequent to the displacement of said compacted web through said tertiary substrate upon an application of a laterally directed force on said compacted web through a respective said hole associated with the elongated cavity housing said compacted web.

2. The calendar of claim 1, wherein said compacted web includes information disposed on a surface thereof.

3. The calendar of claim 1, wherein said longitudinal axis of said elongate cavity is oriented at an angle between substantially 5 degrees and substantially 85 degrees from the horizontal.

4. The calendar of claim 1, further comprising a securement substrate positioned intermediate said primary substrate and said secondary substrate, said securement substrate being configured to retain said compacted webs from being dislodged outwardly from the front face of said secondary substrate.

5. The calendar of claim 1, wherein said primary substrate is formed of a first substrate having said indicia on a first surface thereof and a second substrate which defines said holes, said first substrate being positioned adjacent said second substrate.

6. The calendar of claim 1, wherein said primary substrate defines an opening therein configured to communicate with said collection chamber for facilitating access to said chamber.

7. The calendar of claim 1, wherein said collection chamber comprises a rear substrate spacedly positioned from said tertiary substrate to form a channel there between dimensioned for passage there through of said compacted webs passing through said tertiary substrate.

8. The calendar of claim 1, wherein said tertiary substrate is formed from a thin, rupturable material.

9. The calendar of claim 8, wherein said material is paper.

10. The calendar of claim 4, wherein said securement substrate is formed of a thin, flexible material.

11. The calendar of claim 10, wherein said material is foil.

12. The calendar of claim 7, wherein said primary substrate includes a plurality of spacing members disposed to physically distance said tertiary substrate from said rear substrate.

13. The calendar of claim 6, wherein said collection chamber is fitted with at least one guide member disposed to direct compacted webs within said chamber toward said opening.

14. The calendar of claim 7, wherein said spacing members are disposed about a perimeter of said primary substrate.

15. The calendar of claim 14, wherein said spacing members are furthermore spacedly positioned over a rear surface of said primary substrate.

16. The calendar of claim 3, wherein said angle is substantially 30 degrees.

17. The calendar of claim 1, wherein said primary substrate defines at least one channel extending though said primary substrate dimensioned to facilitate the passage of a dislodgement tool into engagement against said secondary substrate.

* * * * *